US007213274B2

(12) United States Patent
Cotton et al.

(10) Patent No.: US 7,213,274 B2
(45) Date of Patent: May 8, 2007

(54) ASSEMBLY FOR MOUNTING SHOWER OR BATH INSERT, INSERT ASSEMBLY, AND METHOD OF MOUNTING INSERT ASSEMBLY

(75) Inventors: Brian J Cotton, Lighthouse Point, FL (US); Glenn R Cotton, Fort Lauderdale, FL (US)

(73) Assignee: Bath Fitter Franchising, Inc., South Burlington, VT (US)

( * ) Notice: Subject to any disclaimer, the term of this patent is extended or adjusted under 35 U.S.C. 154(b) by 24 days.

(21) Appl. No.: 11/068,576

(22) Filed: Feb. 28, 2005

(65) Prior Publication Data

US 2005/0204462 A1 Sep. 22, 2005

Related U.S. Application Data

(60) Provisional application No. 60/554,828, filed on Mar. 19, 2004.

(51) Int. Cl.
*A47K 1/14* (2006.01)

(52) U.S. Cl. ..... 4/286

(58) Field of Classification Search ..... 4/286, 4/288, 289, 290, 292, 695
See application file for complete search history.

(56) References Cited

U.S. PATENT DOCUMENTS 2,484,240 A 10/1949 Morthland
4,146,939 A * 4/1979 Izzi ..... 4/286
5,372,715 A * 12/1994 Maggard et al. ..... 210/165
5,560,092 A 10/1996 Roiger
5,913,777 A 6/1999 Gerber

FOREIGN PATENT DOCUMENTS

CH 563 763 8/1975

OTHER PUBLICATIONS

Brunswick-Balke-Collender Company advertisement featuring the "Brunswick RUBBERCEPTOR", received in PTO on Nov. 25, 1938, two pages.

* cited by examiner

*Primary Examiner*—Huyen Le
(74) *Attorney, Agent, or Firm*—Burr & Brown

(57) ABSTRACT

An insert assembly for mounting in a shower or bath comprises a retaining ring comprising an engaging structure and an integral retaining flange, and having a retaining ring opening having an internal surface with retaining ring threads; a drain plug comprising a connecting structure and an integral holding flange, and having a drain plug opening and drain plug threads which engage the retaining ring threads; and a shower or bath insert, a portion of the insert being sandwiched between the holding flange and the retaining flange. A drain assembly comprises a retaining ring, a drain plug and a base having a drain structure to which the retaining ring is secured. There is also provided a method of mounting an insert assembly in a shower or bath.

16 Claims, 5 Drawing Sheets

ASSEMBLY FOR MOUNTING SHOWER OR BATH INSERT, INSERT ASSEMBLY, AND METHOD OF MOUNTING INSERT ASSEMBLY

CROSS-REFERENCE TO RELATED APPLICATION

This application claims the benefit of U.S. Provisional Patent Application No. 60/554,828, filed Mar. 19, 2004, the entirety of which is incorporated herein by reference.

FIELD OF THE INVENTION

The present invention is directed to shower and bath inserts. More particularly, the present invention is directed to an assembly for mounting shower and bath inserts in existing showers and baths, and methods for such mounting.

BACKGROUND OF THE INVENTION

There is a continuous need for materials and methods which simplify home improvement projects of all types, and which improve the results of such projects. One area of home improvement that tends to be fairly complicated, due to limits on space, the large size of the completed structure and the need to accommodate incoming and draining water, is the upgrading of baths and showers.

There have been a variety of products offered to simplify installation and/or improve integrity of upgraded showers and baths. Such products generally involve materials to be used to substantially replace all or part of existing showers and baths, or materials to be applied to or combined with existing showers and baths (e.g., "shower inserts" or "bath inserts", which are generally mounted on and combined with existing structures).

By avoiding the need to remove all or large parts of existing showers and baths, a significant amount of labor can be avoided. In addition, parts of the existing showers and baths can provide support for inserts, and/or parts of the elements which cooperate with the existing showers and baths (e.g., drain structures, etc.) can be re-used for the inserts.

However, the mounting of inserts on existing structures is still time consuming, and there are frequently problems with the integrity of the finished product (e.g., leakage from connections between the existing drain and the new drain on the insert). In addition, in many instances, holes are drilled in the insert during installation, thereby detracting from the integrity and wholeness of the insert, and typically further increasing the risk for, or the extent of, water leakage.

There is, accordingly, an ongoing need for assemblies for mounting shower and bath inserts in existing showers and baths, which are effective to simplify the mounting of such inserts, and which result in a finished structure which has improved integrity. There is also an ongoing need for methods of mounting shower and bath inserts which are simpler and which result in a finished structure which has improved integrity.

BRIEF SUMMARY OF THE INVENTION

The present invention provides assemblies (and methods of mounting them) which simplify the mounting of shower and bath inserts in existing showers and baths, and which provide improved integrity in the completed structure. The assemblies of the present invention enable installation of inserts without the need to drill holes in or otherwise alter the insert structure.

In one aspect of the present invention, there is provided an insert assembly for mounting in a shower or bath. The insert assembly of the present invention comprises a retaining ring, a drain plug and an insert.

The retaining ring comprises an engaging structure and a retaining flange, the engaging structure and the retaining flange being integral with each other. The engaging structure has an internal surface defining a retaining ring opening which extends through the retaining ring, the internal surface having retaining ring threads formed thereon.

The drain plug comprises a connecting structure and a holding flange, the connecting structure and the holding flange being integral with each other. The connecting structure has an inside surface and an outside surface, the inside surface defining a drain plug opening which extends through the drain plug, the outside surface having drain plug threads formed thereon. The drain plug threads on the outside surface of the connecting structure engage the retaining ring threads on the internal surface of the engaging structure.

The insert is preferably selected from the group consisting of a shower insert and a bath insert. The insert has an insert opening, and the connecting structure of the drain plug extends at least partially into the insert opening. A portion of the insert is sandwiched between the holding flange of the drain plug and the retaining flange of the retaining ring.

Preferably, in this aspect of the invention, the retaining flange has a first retaining flange major surface and a second retaining flange major surface, and the retaining ring opening extends through the retaining ring and has a retaining ring opening axis which is substantially perpendicular to the first retaining flange major surface and the second retaining flange major surface. In addition, preferably, the holding flange of the drain plug has a first holding flange major surface and a second holding flange major surface, the drain plug opening extends through the drain plug and has a drain plug opening axis which is substantially parallel to (preferably co-linear with) the retaining ring opening axis, and the first holding flange major surface and the second holding flange major surface are substantially parallel to the first retaining flange major surface and the second retaining flange major surface.

According to a second aspect of the present invention, there is provided a drain assembly for mounting an insert in a shower or bath, the drain assembly comprising a retaining ring, a drain plug and a base.

The retaining ring comprises an engaging structure and a retaining flange, the engaging structure and the retaining flange being integral with each other. The engaging structure has an internal surface defining a retaining ring opening which extends through the retaining ring, the internal surface having retaining ring threads formed thereon.

The drain plug comprises a connecting structure and a holding flange, the connecting structure and the holding flange being integral with each other. The connecting structure has an inside surface and an outside surface, the inside surface defining a drain plug opening which extends through the drain plug, the outside surface having drain plug threads formed thereon. The drain plug threads on the outside surface of the connecting structure engage the retaining ring threads on the internal surface of the engaging structure.

The base comprises a drain structure, the engaging structure of the retaining ring extending at least partially into the drain structure, and the retaining ring being secured to the base.

Preferably, in the second aspect of the invention, the retaining ring is secured to the base by at least one attachment means which extends through a hole in the retaining flange and into the base.

Preferably, in the second aspect of the invention, the retaining flange of the retaining ring has a first retaining flange major surface and a second retaining flange major surface, the retaining ring opening extending through the retaining ring having a retaining ring opening axis which is substantially perpendicular to the first retaining flange major surface and the second retaining flange major surface. In addition, preferably, the holding flange of the drain plug has a first holding flange major surface and a second holding flange major surface, the drain plug opening extending through the drain plug having a drain plug opening axis which is substantially parallel to (preferably co-linear with) the retaining ring opening axis, and the first holding flange major surface and the second holding flange major surface are substantially parallel to the first retaining flange major surface and the second retaining flange major surface.

In accordance with the present invention, there is also provided a method of mounting an insert assembly in a shower or bath. The method comprises positioning a retaining ring in a drain structure, the drain structure being located in a base, the retaining ring comprising an engaging structure and a retaining flange, the engaging structure and the retaining flange being integral with each other, the engaging structure having an internal surface defining a retaining ring opening which extends through the retaining ring, and the internal surface having retaining ring threads formed thereon.

The method also comprises then positioning an insert above the retaining ring, the insert having an insert opening, a portion of the insert being positioned above at least a portion of the retaining flange, the insert being selected from the group consisting of a shower insert and a bath insert.

The method also comprises then positioning a drain plug comprising a connecting structure and a holding flange with at least a portion of the holding flange above at least a portion of the retaining flange, the connecting structure and the holding flange being integral with each other, the connecting structure having an inside surface and an outside surface, the inside surface defining a drain plug opening which extends through the drain plug, the outside surface having drain plug threads formed thereon.

The method also comprises then turning the drain plug to thread the drain plug threads on the retaining ring threads, whereby the connecting structure of the drain plug extends at least partially into the insert opening, and a portion of the insert is sandwiched between the holding flange of the drain plug and the retaining flange of the retaining ring.

Preferably, the method further comprises positioning a connecting means through an aperture in the retaining flange and into a gasket (the gasket being positioned between the drain structure and the retaining ring) after positioning the retaining ring in the drain structure, thereby securing the retaining ring to the gasket.

Preferably, the method further comprises positioning an attachment means through a hole in the retaining flange and into the base after positioning the retaining ring in the drain structure, thereby securing the retaining ring to the base.

The invention may be more fully understood with reference to the accompanying drawings and the following detailed description of the invention.

BRIEF DESCRIPTION OF THE DRAWING FIGURES

DETAILED DESCRIPTION OF THE INVENTION

Figure 1:
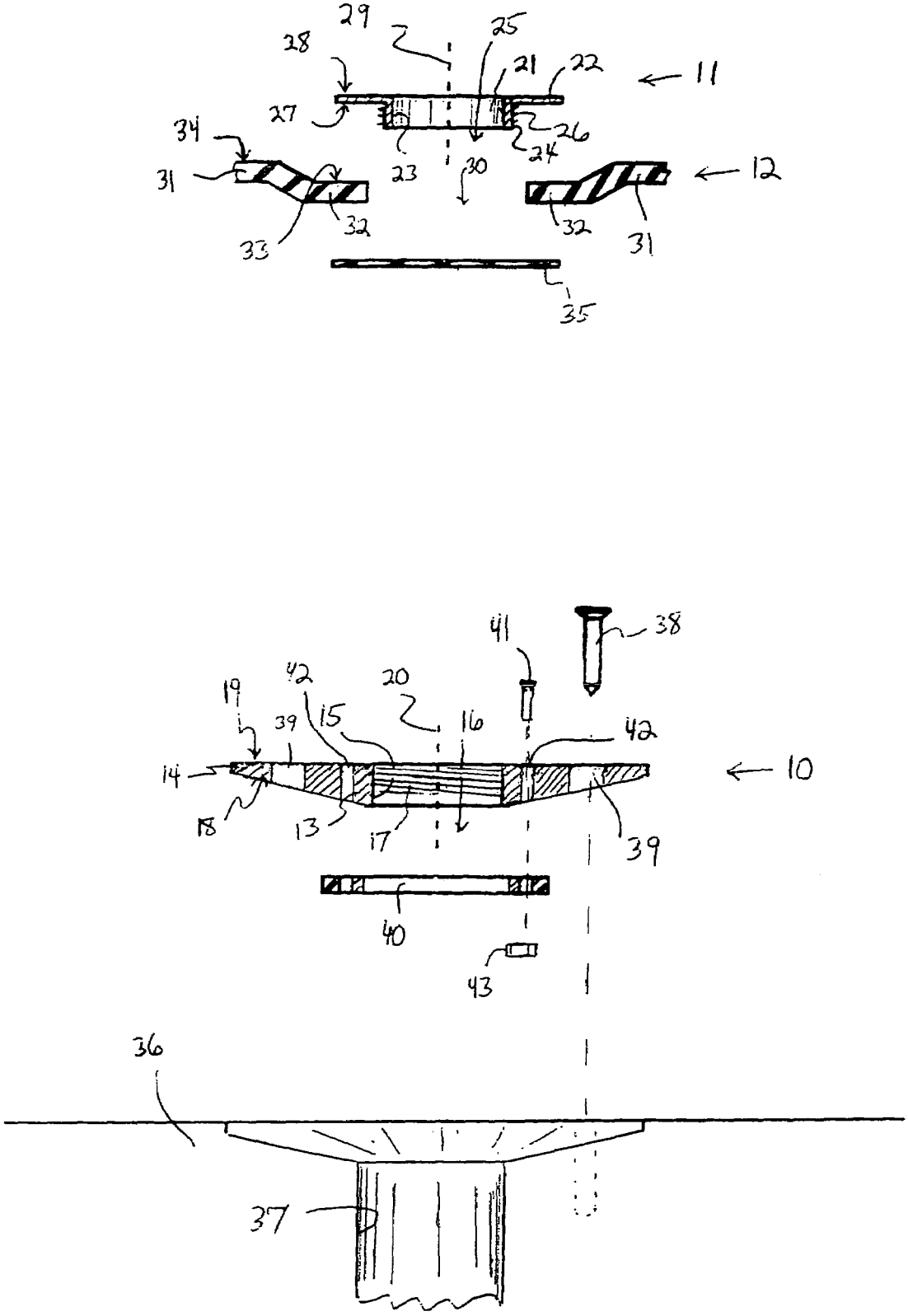
FIG. 1 is an exploded sectional view of an insert assembly in accordance with the present invention, together with a base.

As described above, in a first aspect of the present invention, there is provided an insert assembly for mounting in a shower or bath, the insert assembly comprising a retaining ring, a drain plug and an insert.

As noted above, the retaining ring comprises an engaging structure and a retaining flange, the engaging structure and the retaining flange being integral with each other, the engaging structure having an internal surface defining a retaining ring opening which extends through the retaining ring, the internal surface having retaining ring threads formed thereon.

As noted above, the drain plug comprises a connecting structure and a holding flange, the connecting structure and the holding flange being integral with each other, the connecting structure having an inside surface and an outside surface, the inside surface defining a drain plug opening which extends through the drain plug, the outside surface having drain plug threads formed thereon, and the drain plug threads on the outside surface of the connecting structure engage the retaining ring threads on the internal surface of the engaging structure.

The retaining ring and the drain plug can respectively be made of any suitable material or combination of materials. Preferably, the retaining ring and the drain plug are each made of a material or materials which render them resistant to deflection and degradation. Preferably, the portions of the retaining ring and the drain plug which, in use, contact water are substantially waterproof, i.e., they are made of a material or materials which do not readily absorb water and which do not allow significant amounts of water to pass therethrough. Persons of skill in the art are familiar with a wide variety of materials which can provide the functions desired for the retaining ring and the drain plug. For instance, examples of suitable materials for use in making suitable retaining rings and drain plugs include any non-corrosible and rigid material, including but not limited to stainless steel, plastic, copper, aluminum, etc.

The insert is preferably either a shower insert or a bath insert. The insert can, however, alternatively be any other type of insert. The insert has an insert opening, the connecting structure of the drain plug extending at least partially into the insert opening, a portion of the insert being sandwiched between the holding flange of the drain plug and the retaining flange of the retaining ring. Preferably, the holding flange and the retaining flange each exert a force on the insert, i.e., the insert is pressure-sandwiched between the holding flange and the retaining flange.

The insert can be made of any suitable material or combination of materials. Preferably, the insert is made of a material or materials which render it resistant to substantial deflection and degradation. Preferably, the insert is made of a material which is conducive to molding the insert to the desired shape. Preferably, the surfaces of the insert which, in use, contact water are substantially waterproof, i.e., they are made of a material (or materials) which do not readily absorb water and which do not allow significant amounts of water to pass therethrough. Persons of skill in the art are familiar with a wide variety of materials which can provide the functions desired for the insert, and a wide variety of inserts have been constructed and are well known to those of skill in the art. For instance, several examples of suitable materials for use in making a suitable insert include any rigid moldable material, e.g., metals, fiberglass and plastics, preferably a plastic.

In use, the insert assembly is positioned on a base, the base comprising a drain structure, the engaging structure of the retaining ring extending at least partially into the drain structure, the retaining ring being secured to the base. The base can be any structure on which an insert is desired to be mounted, e.g., a shower or bath structure. A wide variety of such structures exist and are well known in the art. Such structures are made of a wide variety of materials, e.g., ceramics, plastic, metal, concrete, etc.

Preferably, the retaining ring is secured to the base by at least one attachment means, the at least one attachment means preferably extending through a hole in the retaining flange and into a pre-drilled hole in the base. The attachment means can be any suitable device for attaching the retaining ring to the base, e.g., a screw, a nut and bolt combination, a nail, a rivet, etc. For instance, an example of a suitable attachment means is a concrete screw.

Preferably, a lower gasket is positioned between the retaining flange and the base. The lower gasket can be made of any suitable material or combination of materials. Preferably, the lower gasket is made of a material or materials which render it resilient. Preferably, the lower gasket is substantially waterproof, such that it can provide a seal between the retaining ring and the base. Persons of skill in the art are familiar with a wide variety of materials which can provide the functions desired for the lower gasket. For instance, an example of a suitable material for use in making a suitable lower gasket is neoprene.

Preferably, the lower gasket is secured to the retaining ring by at least one connecting means, the at least one connecting means extending through an aperture in the retaining flange and into the lower gasket. The connecting means can be any suitable device for attaching the retaining ring to the base, e.g., a screw, a nut and bolt combination, a nail, a rivet, etc.

Preferably, an upper gasket is positioned between the retaining flange and the portion of the insert which is sandwiched between the holding flange of the drain plug and the retaining flange of the retaining ring. The upper gasket can be made of any suitable material or combination of materials. Preferably, the upper gasket is made of a material or materials which render it resilient. Preferably, the upper gasket is substantially waterproof, such that it can provide a seal between the insert and the retaining ring. Persons of skill in the art are familiar with a wide variety of materials which can provide the functions desired for the upper gasket. For instance, an example of a suitable material for use in making a suitable upper gasket is rubber.

Preferably, the insert has a main portion and a depressed portion, the depressed portion surrounding the insert opening, the depressed portion having an upper surface which is lower than an upper surface of the main portion, and the holding flange of the drain plug is in contact with the upper surface of the depressed portion. In such a way, it is possible to reduce the extent to which the upper surface of the drain plug is above the upper surface of the main portion of the insert, or to make the upper surface of the drain plug flush with or lower than the upper surface of the main portion of the insert, and to facilitate water flowing into the drain plug opening.

As described above, in a second aspect of the present invention, there is provided a drain assembly for mounting an insert in a shower or bath, the drain assembly comprising a retaining ring, a drain plug and a base.

The retaining ring and the drain plug in the second aspect of the present invention are as described above in connection with the first aspect of the present invention. The base comprises a drain structure, the engaging structure of the retaining ring extends at least partially into the drain structure, and the retaining ring is secured to the base.

Preferably, the retaining ring is secured to the base by at least one attachment means, the at least one attachment means extending through a hole in the retaining flange and into a pre-drilled hole in the base. The attachment means can be any suitable device for attaching the retaining ring to the base, e.g., a screw, a nut and bolt combination, a nail, a rivet, etc.

Preferably, a lower gasket is positioned between the retaining flange and the base. Preferably, the lower gasket is secured to the retaining ring by at least one connecting means, the at least one connecting means extending through an aperture in the retaining flange and into the lower gasket. The connecting means can be any suitable device for attaching the retaining ring to the base, e.g., a screw, a nut and bolt combination, a nail, a rivet, etc.

Preferably, an upper gasket is positioned between the retaining flange and the holding flange.

As described above, the present invention is further directed to a method of mounting an insert assembly in a shower or bath, comprising:

positioning a retaining ring in a drain structure, the drain structure being located in a base, the retaining ring comprising an engaging structure and a retaining flange, the engaging structure and the retaining flange being integral with each other, the engaging structure having an internal surface defining a retaining ring opening which extends through the retaining ring, the internal surface having retaining ring threads formed thereon;

then positioning an insert above the base, the insert having an insert opening, a portion of the insert being positioned above at least a portion of the retaining flange, the insert being selected from the group consisting of a shower insert and a bath insert;

then positioning a drain plug comprising a connecting structure and a holding flange with at least a portion of the holding flange above at least a portion of the retaining flange, the connecting structure and the holding flange being integral with each other, the connecting structure having an inside surface and an outside surface, the inside surface defining a drain plug opening which extends through the drain plug, the outside surface having drain plug threads formed thereon; and then turning the drain plug to thread the drain plug threads on the retaining ring threads;

whereby the connecting structure of the drain plug extends at least partially into the insert opening, and a portion of the insert is sandwiched between the holding flange of the drain plug and the retaining flange of the retaining ring.

Preferably, the drain plug threads are threaded on the retaining ring threads to such an extent that the insert is pressure-sandwiched between the retaining flange and the holding flange.

Preferably, the method further comprises removing a drain plate from the drain structure prior to positioning the retaining ring in the drain structure.

Preferably, the method further comprises positioning a lower gasket in the drain structure prior to positioning the retaining ring in the drain structure, whereby after positioning the retaining ring in the drain structure, the lower gasket is positioned between a surface which defines at least part of the drain structure and the retaining ring.

Preferably, the method further comprises positioning a connecting means through an aperture in the retaining flange and into the lower gasket after positioning the retaining ring in the drain structure, thereby securing the retaining ring to the lower gasket.

Preferably, the method further comprises positioning an upper gasket on the retaining flange prior to positioning the insert above the base, whereby after positioning the insert above the base, the upper gasket is positioned between the retaining flange and the insert.

Preferably, the method further comprises positioning an attachment means through a hole in the retaining flange and into the base after the positioning the retaining ring in the drain structure, thereby securing the retaining ring to the base.

Preferably, tape or other filler material can be placed on the base in order to reduce or fill any gap between the base and the insert.

FIG. 1 depicts an embodiment of an insert assembly in accordance with the present invention, together with a base (having a drain structure) on which the insert assembly can be mounted.

The insert assembly of FIG. 1 includes a retaining ring 10, a drain plug 11 and an insert 12.

The retaining ring 10 comprises an engaging structure 13 and a retaining flange 14, the engaging structure 13 and the retaining flange 14 being integral with each other. The engaging structure 13 has an internal surface 15 defining a retaining ring opening 16 which extends through the retaining ring 10. The internal surface 15 has retaining ring threads 17 formed thereon.

The retaining flange 14 of the retaining ring 10 has a first retaining flange major surface 18 and a second retaining flange major surface 19, the retaining ring opening 16 extending through the retaining ring having a retaining ring opening axis 20 which is substantially perpendicular to the first retaining flange major surface 18 and the second retaining flange major surface 19.

The drain plug 11 comprises a connecting structure 21 and a holding flange 22, the connecting structure 21 and the holding flange 22 being integral with each other. The holding flange 22 is positioned above the retaining flange 14. The connecting structure 21 has an inside surface 23 and an outside surface 24. The inside surface 23 defines a drain plug opening 25 which extends through the drain plug 11. The outside surface 24 has drain plug threads 26 formed thereon. The drain plug threads 26 on the outside surface 24 of the connecting structure 21 engage the retaining ring threads 17 on the internal surface 15 of the engaging structure 13.

Figure 3:
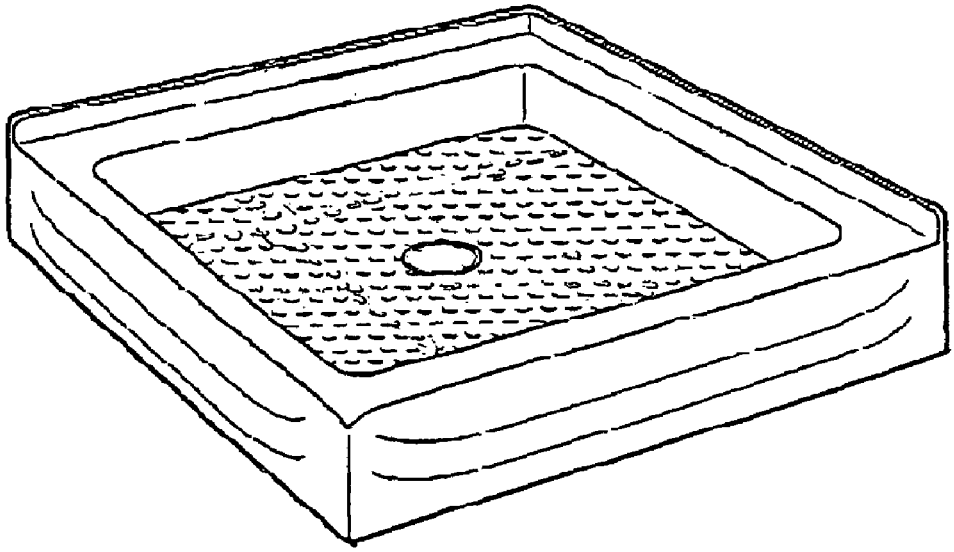
FIG. 3 is a perspective view of an example of a suitable shower insert.
Figure 4:
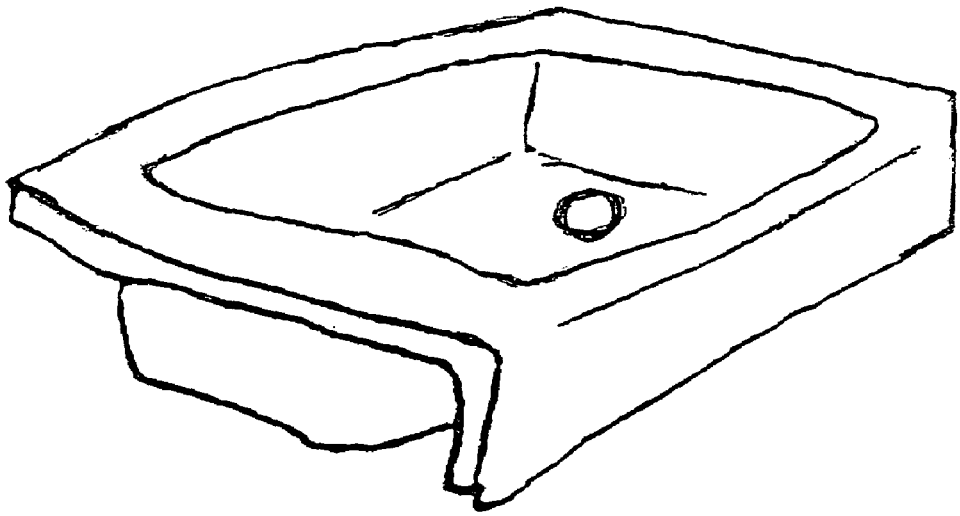
FIG. 4 is a perspective view of an example of a suitable bath insert.

The holding flange 22 of the drain plug 11 has a first holding flange major surface 27 and a second holding flange major surface 28. The drain plug opening 25 has a drain plug opening axis 29 which is substantially parallel to (and co-linear with) the retaining ring opening axis 20. The first holding flange major surface 27 and the second holding flange major surface 28 are substantially parallel to the first retaining flange major surface 18 and the second retaining flange major surface 19. As described above, the insert 12 is preferably a shower insert or a bath insert, only a portion of the insert 12 being shown in FIG. 1. FIG. 3 depicts an example of a suitable shower insert. FIG. 4 depicts an example of a suitable bath insert. The insert 12 has an insert opening 30, and the connecting structure 21 of the drain plug 11 extends at least partially into the insert opening 30. A portion of the insert 12 is located between the holding flange 22 of the drain plug 11 and the retaining flange 14 of the retaining ring 10, such that upon screwing the drain plug threads 26 into the retaining ring threads 17 to bring the drain plug 11 toward the retaining ring 10, the insert 12 becomes pressure-sandwiched between the drain plug 11 and the retaining ring 10.

The insert has a main portion 31 and a depressed portion 32, the depressed portion 32 surrounding the insert opening 30, the depressed portion 32 having an upper surface 33 which is lower than an upper surface 34 of the main portion 31. In use, the holding flange 22 of the drain plug 11 is in contact with the upper surface 33 of the depressed portion 32.

An upper gasket 35 is positioned between the retaining flange and the portion of the insert which is sandwiched between the holding flange 22 and the retaining flange 14.

FIG. 1 depicts a base 36 on which the insert assembly can be mounted, the base 36 comprising a drain structure 37. The engaging structure 13 of the retaining ring 10 extends at least partially into the drain structure 37. The retaining ring 10 is secured to the base with concrete screws 38 which extend through holes 39 in the retaining flange 14 and into the base 36.

A lower gasket 40 is positioned between the retaining flange 14 and the base 36. The lower gasket 40 is secured to the retaining ring 10 with bolts 41 which extend through apertures 42 in the retaining flange 14 through holes in the lower gasket 40 and into engagement with a nut 43 on the opposite side of the lower gasket 40. The lower gasket 40 is soft, so that it can conform to the shape of the underside of the retaining ring.

Figure 2:
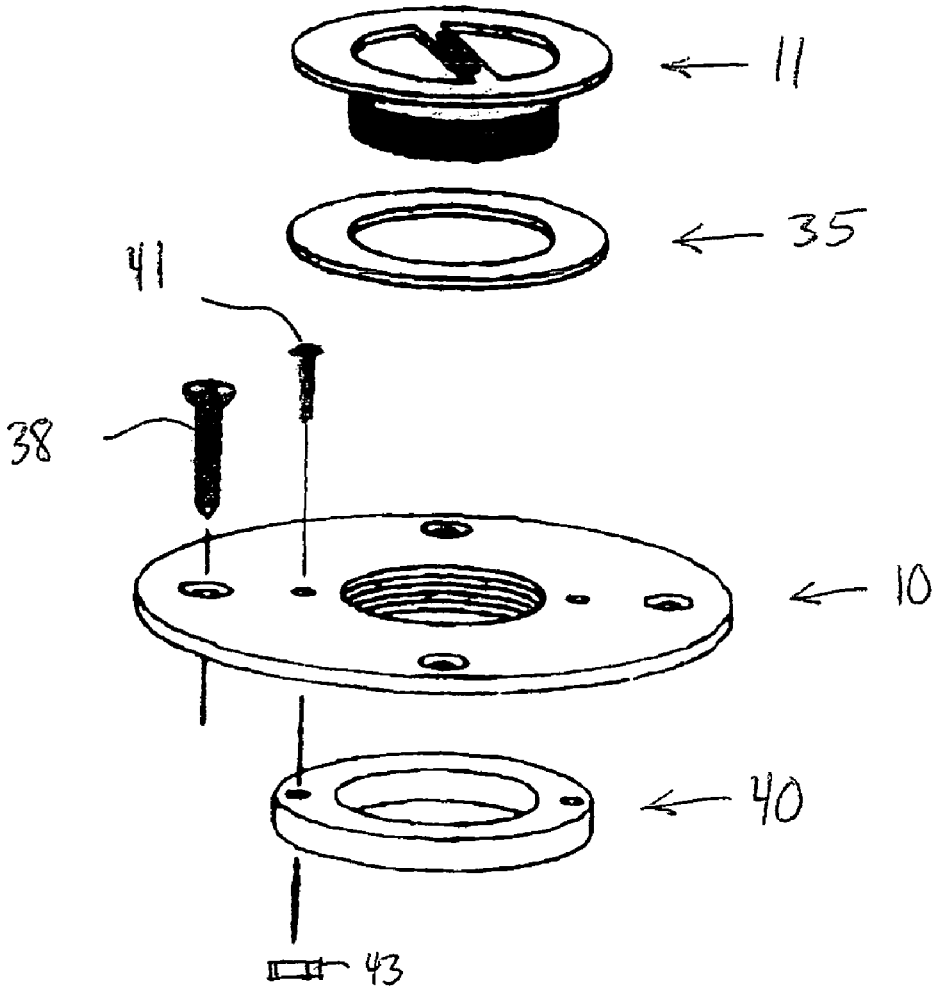
FIG. 2 is a perspective view of an insert assembly in accordance with the present invention.

FIG. 2 is a perspective view of a retaining ring 10, a drain plug 11, an upper gasket 35, a lower gasket 40, a concrete screw 38, a bolt 41 and a nut 43 of an insert assembly in accordance with the present invention.

Figure 5:
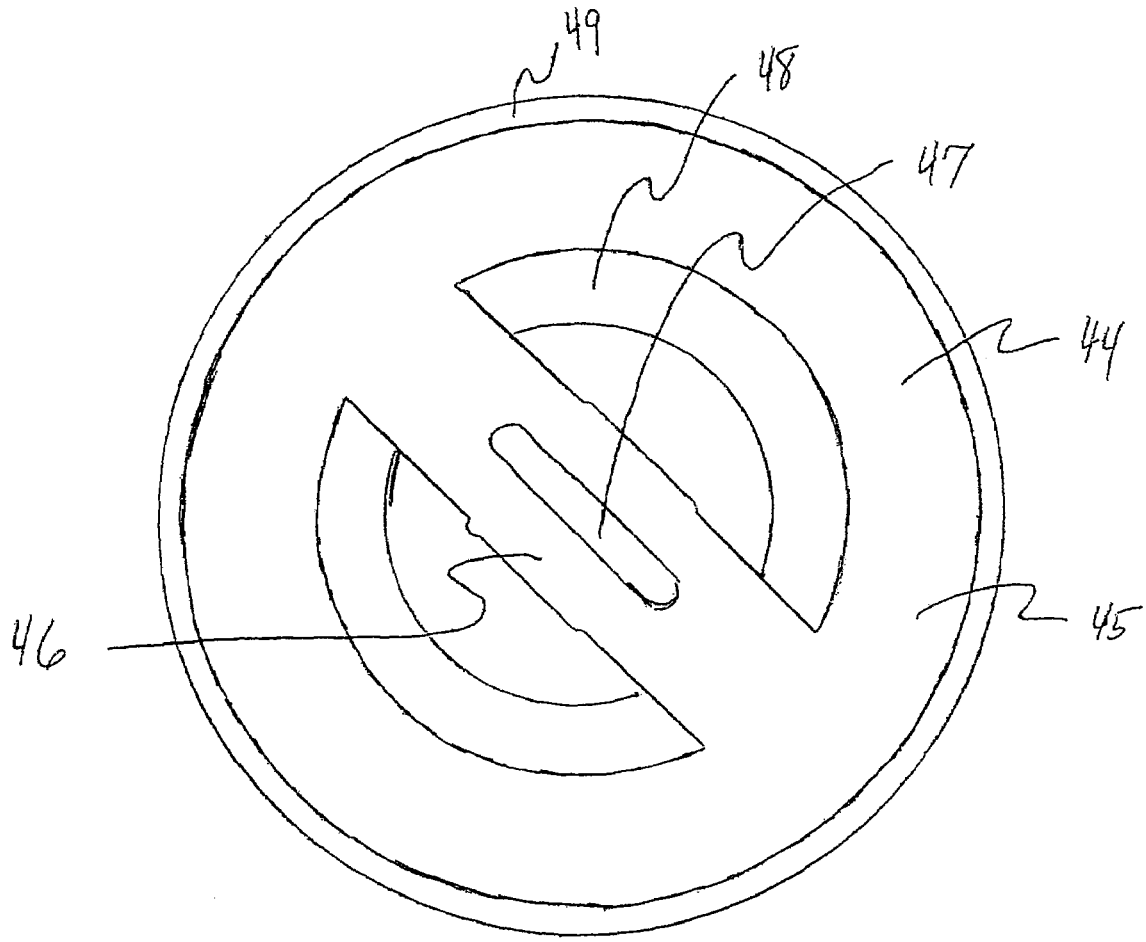
FIG. 5 is a top view of a drain plug in accordance with the present invention.

In accordance with a further aspect of the present invention, there is preferably provided structure which assists in simplifying turning the drain plug to thread the drain plug threads into the retaining ring threads. For example, one preferred type of such structure is depicted in FIG. 5, which is a top view of a drain plug 11 having a cross plate 44 attached thereto in accordance with the present invention. In the drain plug 11 shown in FIG. 5, a cross plate 44 is provided which includes a generally annular section 45 which contacts a top surface 48 of the drain plug 11 and a diametrical cross portion 46 which extends across the drain plug opening 25. The cross portion 46 has a slot 47 through which a tool can be inserted whereby upon cranking the tool clockwise or counter-clockwise relative to the top surface of the drain plug 11, the drain plug threads 26 are screwed into or out of, respectively, the retaining ring threads 17. The cross plate 44 can be attached to the drain plug 11 in any suitable manner, e.g., with an adhesive or structurally. For example, the cross plate 44 is attached to the drain plug shown in FIG. 5 by applying adhesive to the top surface 48 of the drain plug 11 and then press-fitting the cross plate 44 onto the top surface 48 and into a raised rim 49 located at the outer periphery of the top surface 48 of the drain plug 11.

The expression "substantially perpendicular," as used herein, means forming an angle of between about 80 degrees and about 100 degrees. The expression "substantially parallel," as used herein, means forming an angle of between about −10 degrees and about 10 degrees.

Any two or more structural parts of the drain assemblies and insert assemblies described above can be integrated. Any structural part or parts of the drain assemblies and insert assemblies described above can be provided in two or more parts (which are held together, if necessary). Similarly, any two or more method steps can be conducted simultaneously, and/or any method step can be conducted in a series of method steps.

The invention claimed is:

1. An insert assembly for mounting in a shower or bath, said insert assembly comprising:

a retaining ring, said retaining ring comprising an engaging structure and a retaining flange, said engaging structure and said retaining flange being integral with each other, said engaging structure having an internal surface defining a retaining ring opening which extends through said retaining ring, said internal surface having retaining ring threads formed thereon;

a drain plug, said drain plug comprising a connecting structure and a holding flange, said connecting structure and said holding flange being integral with each other, said connecting structure having an inside surface and an outside surface, said inside surface defining a drain plug opening which extends through said drain plug, said outside surface having drain plug threads formed thereon, said drain plug threads on said outside surface of said connecting structure engaging said retaining ring threads on said internal surface of said engaging structure; and an insert selected from the group consisting of a shower insert and a bath insert, said insert having an insert opening, said connecting structure of said drain plug extending at least partially into said insert opening, a portion of said insert being sandwiched between said holding flange of said drain plug and said retaining flange of said retaining ring, wherein said insert assembly is positioned above a base, said base comprising a drain structure, said engaging structure of said retaining ring extending at least partially into said drain structure, said retaining ring being secured to said base by at least one attachment means, said at least one attachment means extending through a hole in said retaining flange and into said base.

2. An insert assembly as recited in claim 1, wherein said retaining flange of said retaining ring has a first retaining flange major surface and a second retaining flange major surface, said retaining ring opening extending through said retaining ring having a retaining ring opening axis which is substantially perpendicular to said first retaining flange major surface and said second retaining flange major surface, and wherein said holding flange of said drain plug has a first holding flange major surface and a second holding flange major surface, said drain plug opening extending through said drain plug having a drain plug opening axis which is substantially parallel to said retaining ring opening axis, said first holding flange major surface and said second holding flange major surface being substantially parallel to said first retaining flange major surface and said second retaining flange major surface.

3. An insert assembly as recited in claim 1, further comprising a lower gasket positioned between said retaining flange and said base.

4. An insert assembly as recited in claim 3, wherein said lower gasket is secured to said retaining ring by at least one connecting means, said at least one connecting means extending through an aperture in said retaining flange and through at least a portion of said lower gasket.

5. An insert assembly as recited in claim 1, further comprising an upper gasket positioned between said portion of said insert and said retaining flange.

6. An insert assembly as recited in claim 1, wherein said insert has a main portion and a depressed portion, said depressed portion surrounding said insert opening, said depressed portion having an upper surface which is lower than an upper surface of said main portion, and wherein said holding flange of said drain plug is in contact with said upper surface of said depressed portion.

7. A drain assembly for mounting an insert in a shower or bath, said drain assembly comprising:

a retaining ring, said retaining ring comprising an engaging structure and a retaining flange, said engaging structure and said retaining flange being integral with each other, said engaging structure having an internal surface defining a retaining ring opening which extends through said retaining ring, said internal surface having retaining ring threads formed thereon;

a drain plug, said drain plug comprising a connecting structure and a holding flange, said connecting structure and said holding flange being integral with each other, said connecting structure having an inside surface and an outside surface, said inside surface defining a drain plug opening which extends through said drain plug, said outside surface having drain plug threads formed thereon, said drain plug threads on said outside surface of said connecting structure engaging said retaining ring threads on said internal surface of said engaging structure; and a base, said base comprising a drain structure, said engaging structure of said retaining ring extending at least partially into said drain structure, said retaining ring being secured to said base, said retaining ring being secured to said base by at least one attachment means, said at least one attachment means extending through a hole in said retaining flange and into said base.

8. An insert assembly as recited in claim 7, further comprising a lower gasket positioned between said retaining flange and said base.

9. An insert assembly as recited in claim 8, wherein said lower gasket is secured to said retaining ring by at least one connecting means, said at least one connecting means extending through an aperture in said retaining flange and through at least a portion of said lower gasket.

10. An insert assembly as recited in claim 7, further comprising an upper gasket positioned between said holding flange and said retaining flange.

11. An insert assembly as recited in claim 7, wherein said retaining flange of said retaining ring has a first retaining flange major surface and a second retaining flange major surface, said retaining ring opening extending through said retaining ring having a retaining ring opening axis which is substantially perpendicular to said first retaining flange major surface and said second retaining flange major surface, and wherein said holding flange of said drain plug has a first holding flange major surface and a second holding flange major surface, said drain plug opening extending through said drain plug having a drain plug opening axis which is substantially parallel to said retaining ring opening axis, said first holding flange major surface and said second holding flange major surface being substantially parallel to said first retaining flange major surface and said second retaining flange major surface.

12. A method of mounting an insert assembly in a shower or bath, comprising:

positioning a retaining ring in a drain structure, said drain structure being located in a base, said retaining ring comprising an engaging structure and a retaining flange, said engaging structure and said retaining flange being integral with each other, said engaging structure having an internal surface defining a retaining ring opening which extends through said retaining ring, said internal surface having retaining ring threads formed thereon;

then positioning an insert above said base, said insert having an insert opening, a portion of said insert being positioned above at least a portion of said retaining flange, said insert being selected from the group consisting of a shower insert and a bath insert;

then positioning a drain plug comprising a connecting structure and a holding flange with at least a portion of said holding flange above at least a portion of said retaining flange, said connecting structure and said holding flange being integral with each other, said connecting structure having an inside surface and an outside surface, said inside surface defining a drain plug opening which extends through said drain plug, said outside surface having drain plug threads formed thereon;

then turning said drain plug to thread said drain plug threads on said retaining ring threads; and positioning an attachment means through a hole in said retaining flange and into said base after said positioning said retaining ring in said drain structure, thereby securing said retaining ring to said base, whereby said connecting structure of said drain plug extends at least partially into said insert opening, and a portion of said insert is sandwiched between said holding flange of said drain plug and said retaining flange of said retaining ring.

13. A method of mounting an insert assembly as recited in claim 12, further comprising removing a drain plate from said drain structure prior to said positioning a retaining ring in said drain structure.

14. A method of mounting an insert assembly as recited in claim 12, further comprising positioning a lower gasket in said drain structure prior to said positioning a retaining ring in said drain structure, whereby after said positioning a retaining ring in said drain structure, said lower gasket is positioned between at least a portion of a surface of said drain structure and said retaining ring.

15. A method of mounting an insert assembly as recited in claim 14, further comprising positioning a connecting means through an aperture in said retaining flange and through at least a portion of said lower gasket after said positioning said retaining ring in said drain structure, thereby securing said retaining ring to said lower gasket.

16. A method of mounting an insert assembly as recited in claim 12, further comprising positioning an upper gasket on said retaining flange prior to said positioning said insert above said base, whereby after said positioning said insert above said base, said upper gasket is positioned between said retaining flange and said insert.

* * * * *